United States Patent [19]

Crum

[11] Patent Number: 4,577,902

[45] Date of Patent: Mar. 25, 1986

[54] ROCKER RECLINER AND AWAY-FROM-THE-WALL RECLINER CHAIRS

[75] Inventor: Michael A. Crum, LaGrange, Ky.

[73] Assignee: Leggett & Platt, Incorporated, Carthage, Mo.

[21] Appl. No.: 464,874

[22] Filed: Feb. 8, 1983

[51] Int. Cl.[4] ..... A47C 1/02

[52] U.S. Cl. ..... 297/85; 297/259

[58] Field of Search ..... 297/85, 259, 270, 68

[56] References Cited

U.S. PATENT DOCUMENTS

| | | | |
|---|---|---|---|
| 3,162,483 | 12/1964 | Fletcher . | |
| 3,352,601 | 11/1967 | Cycowicz | 297/270 |
| 3,572,823 | 3/1971 | Hampton . | |
| 3,730,585 | 5/1973 | Rogers, Jr. et al. . | |
| 3,768,859 | 10/1973 | Rogers | 297/85 |
| 3,858,932 | 1/1975 | Crum et al. . | |
| 4,071,275 | 1/1978 | Rogers, Jr. . | |
| 4,099,776 | 7/1978 | Crum et al. . | |
| 4,108,491 | 8/1978 | Rogers, Jr. . | |
| 4,291,913 | 9/1981 | Kowalski | 297/68 |
| 4,306,746 | 12/1981 | Crum . | |
| 4,337,977 | 7/1982 | Rogers | 297/85 |
| 4,350,387 | 9/1982 | Rogers, Jr. . | |
| 4,352,523 | 10/1982 | Holobaugh | 297/85 |

*Primary Examiner*—Francis K. Zugel

*Attorney, Agent, or Firm*—Wood, Herron & Evans

[57] ABSTRACT

A three-position away-from-the-wall recliner and a three-position rocker recliner are disclosed wherein the body support including the seat and backrest of both recliners are movable between upright, intermediate or TV and full recline positions. Both recliners include a mechanism operable upon release of a latch to move the body support of the recliner between upright and TV positions as a consequence of the weight of a person sitting in the recliner propelling the body support to the TV position. Both recliners utilize a common recliner linkage to support the body support from a fixed base. In the away-from-the-wall recliner, the recliner linkage is mounted upon a forward biased four bar linkage mechanism such that upon release of the latch, the four bar linkage swings forwardly, propelling the body support from the upright to the TV position. In the rocker recliner, this same recliner linkage pivots about a front pivot of a rocker base plate and drops the rear of the seat upon release of the latch. Because identical recliner linkages are common to both recliner mechanisms, identical chair frames may be mounted upon either mechanism to create either an away-from-the-wall recliner or a rocker recliner.

20 Claims, 9 Drawing Figures

ROCKER RECLINER AND AWAY-FROM-THE-WALL RECLINER CHAIRS

This invention relates to recliner chairs and particularly to an improved rocker recliner chair and an improved away-from-the-wall recliner chair.

Reclining chairs which move between upright, intermediate recline and full recline positions, i.e., so-called three-position chairs, are well known to the prior art. In the conventional three-position type reclining chair, the body support is commonly mounted on a stationary base for pivotal movement between the upright, intermediate or so-called TV position, and full recline position. The seat and backrest may be fixed one to the other in which event the chair is referred to as a so-called "two-way" reclining chair. Or, the backrest may pivot or tilt rearwardly relative to the seat as the chair moves toward that full recline position in which event the chair is referred to as the "three-way" reclining chair. A typical such three-position "three-way" reclining chair, which includes a leg rest, and a backrest tiltably relative to the seat. is shown in U.S. Pat. No. 3,572,823, entitled "Reclining Chair", invented by E. L. Hampton.

Reclining chairs of the type described hereinabove must be disposed a substantial distance out from a wall or other obstruction which might be behind it so as to provide sufficient space to permit the chair backrest to be moved to the full recline position when desired by the user. The space which must be provided between the backrest of the reclining chair and a wall, for example, is therefore useless or waste space when the reclining chair is in the upright position. Consequently, so-called "close-to-the-wall" reclining chairs have been developed and are now popular because they eliminate the need for such space behind the chair.

One close-to-the-wall type of reclining chair which may be moved from an upright to a full recline position without any substantial rearward or aft movement of the headrest or top portion of the chair's backrest is illustrated and described in U.S. Pat. Nos. 3,858,932, entitled "Reclining Chair Assembly", invented by D. Crum, et al, and 4,099,776 entitled "Control Assembly for a Reclining Chair", invented by D. Crum, et al. The reclining chairs shown in these patents each mounts the chair's arms on a roller and track so that the complete chair other than the supporting base move forwardly as the seat and backrest are tilted from the upright to the full recline position.

Another type of reclining chair which may be moved from an upright to the full recline position without any substantial rearward movement of the top portion of the chair's backrest utilizes an all linkage system instead of a roller slide to support the chair on the base as it moves away from a wall and is reclined. In general, these all linkage style away-from-the-wall recliners operate upon the principle of supporting the recliner linkage mechanism upon a four bar linkage system operable to move the recliner linkage away from a back wall as the chair moves from upright to TV and then full recline positions. Such an all linkage away-from-the-wall recliner mechanism is disclosed in my earlier U.S. Pat. No. 4,306,746.

For the most part, all linkage away-from-the-wall recliner mechanisms have superseded and replaced roller and track supported away-from-the-wall mechanisms because of the greater ease with which the all linkage style mechanisms may be operated. In my U.S. Pat. No. 4,306,746 the recliner linkage mechanism is supported from a four bar mechanism which comprises a base link at the bottom, a carrier link at the top, and front and rear leg links so balanced that in the upright position of the chair the carrier link is slightly biased rearwardly. To open the chair either the armrests are moved forwardly relative to the backrest (as shown in the patent) or a handle attached to the four bar mechanism is actuated (not shown in the patent but used in commercial practice), thereby causing the carrier link to move over-center relative to the supporting front and rear legs of the four bar mechanism. As soon as the carrier link goes over-center relative to the supporting links, the four bar linkage is biased forwardly so that the weight of the person sitting in the chair translates the recliner linkage forwardly upon its supporting four bar mechanism.

Recently there has been available on the market an all linkage away-from-the-wall recliner wherein the supporting four bar linkage is biased at all times to a forward position. This mechanism, a so-called forward bias mechanism, differs from the all linkage mechanism described hereinabove in that the pivots of the legs of the supporting four bar mechanism are shifted rearwardly relative to the supporting base so that the upper carrier link of the four bar mechanism never goes over-center. Instead, the four bar linkage always stays biased forward ready to fall into a TV position. It is locked in an upright position by a handle operated locking linkage. This locking linkage retains the chair in its upright position until the lock is released when the chair falls of its own weight or that of a person seated in the chair into the TV position. This forward biased mechanism is disclosed in U.S. Pat. No. 4,350,387. In this patent the locking linkage for retaining the chair in the upright position interconnects the chair seat to the footrest so that when the footrest is fully retracted the locking linkage automatically locks to retain the chair in an upright position. A handle is provided on the armrest of the chair to release the footrest lock, thereby allowing the chair to fall of its own weight or the weight of the chair's occupant downwardly and forwardly into the TV position.

The all linkage close-to-the-wall forward bias recliner chair disclosed in the above identified U.S. Pat. No. 4,350,387 is advantageously characterized by the ease with which it is openable or movable from the upright to the TV position upon release of the footrest lock. But, the forward biased chair disclosed in this U.S. Pat. No. 4,350,387 has several disadvangates over earlier all linkage close-to-the-wall mechanisms, as for example that disclosed in U.S. Pat. No. 4,306,746. The primary disadvantage is the greater force required to propel the forward biased chair from the TV to the full recline position. The earlier all linkage close-to-the-wall chairs or even the still older chairs which did not move away from a back wall when they opened, were much easier to propel from the TV to the full recline position.

It has therefore been one objective of this invention to provide an all linkage close-to-the-wall type recliner mechanism which is forward biased in the upright position such that upon release of a footrest lock the weight of the occupant will automatically move the chair from the upright to the TV position but which is very easily movable from the TV to the full recline position.

Still another objective of this invention has been to provide a weight biased forward all linkage close-to-the-wall recliner linkage wherein the carrier link of a four bar linkage which supports the seat of the chair has a substantial movement from upright to TV position, but has no further movement as the chair goes from TV to full recline position so that minimal physical effort is required by an occupant of the chair to effect movement from the TV to the full recline position.

Still another objective of this invention has been to provide an all linkage close-to-the-wall recliner chair in which the chair is weight biased forward in the upright position of the chair and moves automatically from the upright to the TV position upon release of a latch, but which is much easier to operate and effect movement from the TV to the full recline position than prior art weight biased forward recliner chairs.

The primary reason that the forward biased chair disclosed in U.S. Pat. No. 4,350,387 is so difficult to move from the TV to the full recline position is that it utilizes a five bar rather than a "four bar linkage" to support the carrier link relative to the base for forward away-from-the-wall travel. The need for this five bar linkage arises because the carrier link and seat of this forward bias chair move very little forwardly in going from the upright to the TV position. Therefore, substantially more forward travel of the carrier link and seat is required in order to move the seat and attached backrest to the full recline position if the top of the backrest is to clear a wall located behind the chair.

It has therefore been another objective of this invention to provide a forward biased recliner chair in which the full forward travel of the carrier link occurs in going from upright to TV position so that there is therefore no need for further forward travel of the carrier link in going from TV to full recline position. As a result, the chair seat and backrest may be easily moved from TV to full recline position by simply pivoting the seat relative to the carrier link. The forward bias all linkage close-to-the-wall mechanism of this invention which accomplishes that objective utilizes a four bar mechanism to support the carrier link in which all of the forward travel of the carrier link occurs in going from the upright to the TV position. All that is then required to move the chair from the TV to the full recline position is for the seat to pivot about the carrier link so that the front of the seat moves upwardly while the backrest pivots about the back of the seat in a rearward direction. The two motions are balanced so that very little effort is required on the part of a person seated in the chair pushing against the backrest to cause the front of the seat to lift and the backrest to move backwardly.

Another disadvantage of prior art weight biased forward all linkage close-to-the-wall recliner chairs has been their inability to withstand severe wear tests. Such tests are made by cycling the chair through numerous cycles of operation between upright and full recline positions.

It has therefore been another objective of this invention to provide an all linkage away-from-the-wall chair which is weight biased forward but which will meet even the most severe wear test. To that end the recliner of this invention utilizes a minimal number of parts and pivots subject to wear. Prior art chairs of this type have utilized much more complex mechanisms with many more pivots with the result that they wear out and fail much more quickly under severe operating or test conditions than the invention of this application.

There has been a longstanding but unfulfilled desire on the part of the upholstered action chair industry for a recliner mechanism which would enable both a close-to-the-wall type of recliner and a rocker recliner to be mounted upon a common frame and which would give the same reclining positions to both chairs with the same feel. The advantage of such a mechanism is that it would enable identical appearing chairs having the same recliner positions to be sold in either a close-to-the-wall style recliner chair or a rocker recliner style. The advantage of such a chair to a merchant is that for the first time he would be able to set two chairs in his store which looked exactly alike side-by-side and move them through the three positions but sell them as either a close-to-the-wall style recliner or a rocker style recliner. Heretofore though there has been no recliner linkage available which could be mounted upon the same identical chair frame and constructed so as to create either an away-from-the-wall recliner or a rocker recliner having the same identical three recliner positions and substantially the same feel when moved through those three positions.

It has therefore been another objective of this invention to provide a recliner linkage mechanism mountable upon a fixed base to create an away-from-the-wall style of recliner and mountable upon a rocker base to create a rocker recliner, both of which when mounted upon a common frame are movable through three different positions with the same movement and feel to a person seated within the chair.

Another objective of this invention has been to provide a recliner mechanism mountable upon a four bar mechanism to create an away-from-the-wall style of recliner chair and mountable upon a rocker recliner base to create a rocker recliner chair, both of which when mounted upon a common frame are movable through the same three recliner positions.

This last objective is achieved by a three position recliner linkage mechanism wherein the seat support plate of the mechanism is suspended from a carrier link by a recliner linkage. The mechanism includes an ottoman or footrest linkage which is supported from the front of the seat support plate. The carrier link is mountable upon a fixed base to create an away-from-the-wall style of recliner chair and is mountable upon a rocker base to create a rocker recliner chair. In the away-from-the-wall recliner, the carrier link is attached to the fixed base by a pair of front and rear legs such that the fixed base, the carrier link and the two legs create a four bar linkage, which four bar linkage is biased forwardly so that the weight of a chair occupant acting downardly upon the carrier link through the attached seat support plate has the effect of urging the carrier link and the four bar seat support plate to move forwardly from the upright to the TV position. The rear leg of the four bar mechanism is connected to the footrest linkage such that as the rear leg is pivoted to a TV position, it propels the legrest outwardly. To prevent the chair from moving from the upright to the TV position, the linkage mechanism is provided with a latch for restraining footrest movement and consequently any movement of the recliner linkage into the TV position from the upright position until the latch is released. In the illustrated embodiment the latch is handle operated from a handle attached to the armrest of the chair.

The recliner linkage is so constructed that when in the TV position any pressure on the backrest of the chair will result in the seat link being moved by the backrest linkage upwardly and forwardly from a TV to a full recline position while simultaneously the backrest pivots rearwardly relative to the seat link. To return the chair from the full recline to the TV position, all that is required is for the occupant of the chair to release his weight from against the back of the chair or sit up. Thereby, the seat will return to the TV position while the backrest pivots upwardly to the TV position. To move the chair from the TV to the upright position the occupant of the chair pushes downwardly on the footrest thereby closing the footrest mechanism while returning the recliner linkage to its full upright position. In the full upright position the latch attached to the footrest moves to a latched condition in which position it will remain until the latch is released by actuation of the handle.

The rocker recliner mechanism of this invention utilizes the same identical recliner, footrest, and backrest linkages as the away-from-the-wall recliner mechanism described hereinabove. Rather than supporting the carrier link though from a four bar linkage as in the away-from-the-wall recliner, the carrier link of the rocker recliner is supported from a fixed front pivot to the rocker base plate. In moving from upright to TV position, the weight of a person seated in the chair simply causes the rear of the carrier plate and the attached seat support plate to drop downwardly relative to the front pivot. In the process of the seat dropping downwardly at the rear the footrest linkage is extended. As the seat drops downwardly, in addition to causing the footrest to be extended, a rocker locking linkage is actuated so as to secure the rocker against rocking movement.

The rocker recliner mechanism is normally retained in the upright position against movement to the TV position until the latch is released. Only upon release of the latch is the footrest free to move outwardly and the seat to drop downwardly at the rear. In the preferred embodiment, the latch is handle operated from a small handle attached to the armrest of the chair.

To move the rocker recliner mechanism from the TV to the full recline position, all that is required is for the occupant of the chair to lean backward upon the backrest. This has the effect of moving the seat upwardly and forwardly relative to the backrest in the same way as was described hereinabove relative to the close-to-the-wall embodiment. To return the chair from the full recline to the TV position, the occupant of the chair simply removes his weight from the backrest of the chair by leaning forward. This results in the seat being lowered and swung backwardly while the backrest moves upwardly to the TV position. To return the mechanism from the TV to the upright position, the occupant of the chair pushes downwardly with his legs upon the footrest, thereby closing the footrest while lifting the rear of the seat upwardly to the upright position. Simultaneously with movement of the chair from the TV to the upright position, the rocker latching mechanism is released so that the chair is again free for rocking movement.

The recliner mechanisms of this invention have numerous advantages over prior art recliner mechanisms. Among those advantages is the ability of the recliner linkage system to be mounted upon one style of base to create an away-from-the-wall rocker recliner and to be mounted upon another style of base to create a rocker recliner. This enables a single chair frame to be utilized to create either an away-from-the-wall recliner or a rocker recliner, both of which are movable through the same motions with the same actuating mechanism so that a purchaser has a choice of styles of chairs availabe in the same chair frame.

This mechanism also has the advantage of creating a very desirable and relatively inexpensive away-from-the-wall style of chair which is always weight biased toward a TV position from an upright position such that it may be very easily moved from the upright to the TV position and from the TV to the full reclined position. Heretofore, all weight biased forward chairs have been substantially more difficult to move from the TV to the full reclined position.

Still another advantage of this invention is that it creates an improved rocker recliner chair wherein the seat and backrest of the chair may be moved to a TV position from an upright position by simply releasing a latch and allowing the weight of the person seated in the chair to move the rear of the seat downwardly relative to the front of the seat while propelling the footrest of the chair outwardly to an extended position. Rocker recliners which have heretofore been capable of moving to a pitched or "bucketed" position wherein the rear of the seat was lower relative to the front of the seat in the TV position than in an upright position, have utilized a handle actuated roller movable over a fixed base to crank the front of the seat upwardly relative to the base as the chair is moved from the upright to the TV position. Such a handle operated cranking operation is much less desirable than having the weight of a person seated in the chair effect this "bucketed" movement because of the substantial effort required to force the front of the chair upwardly against the weight of the person seated in the chair with his legs extended.

These and other objects and advantages of this invention will be more readily apparent from the following description of the drawings in which.

AWAY-FROM-THE-WALL RECLINER EMBODIMENT

Figure 1:
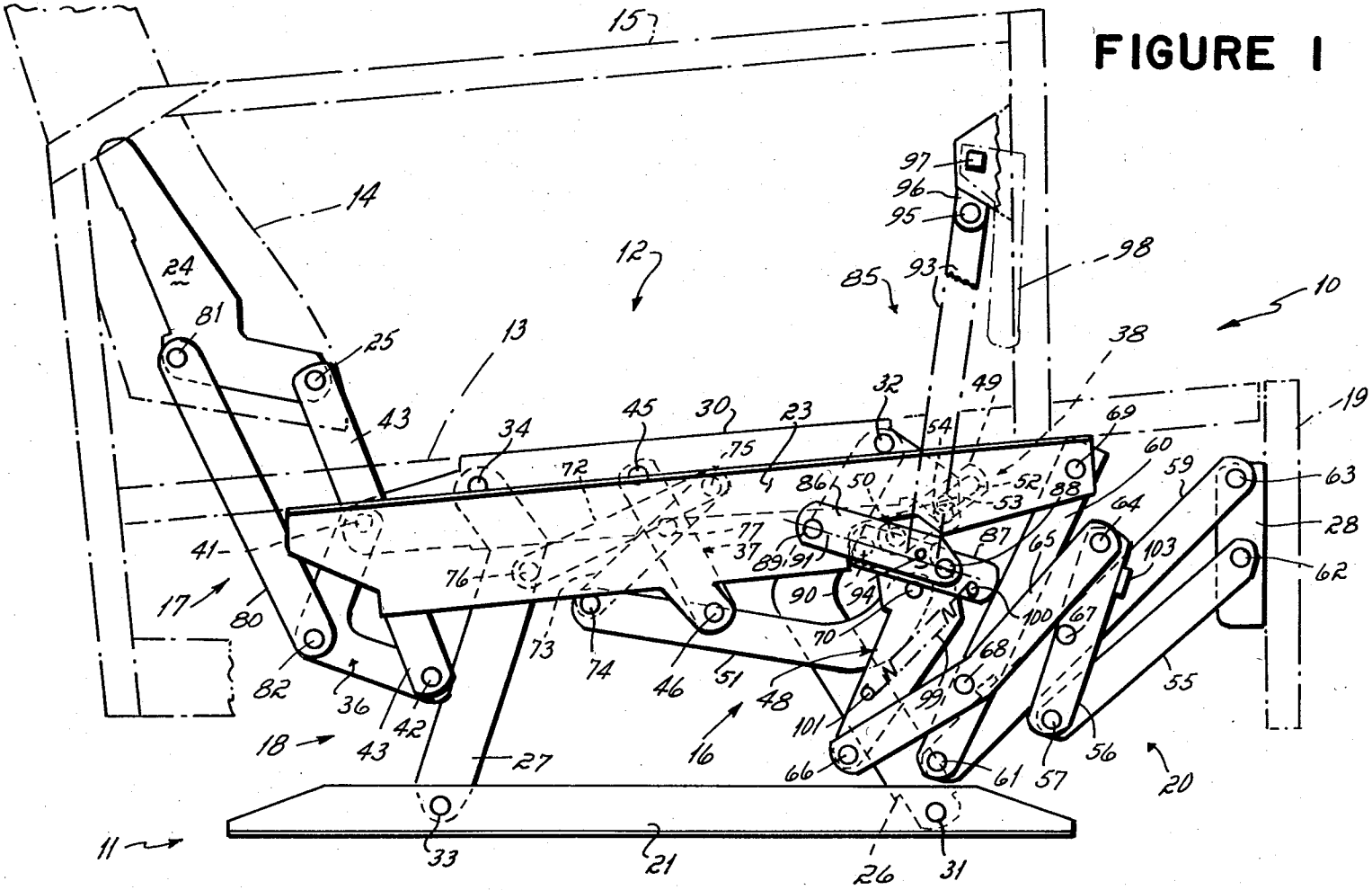
FIG. 1 is a side elevational view of a three-position away-from-the-wall style of recliner chair incorporating the invention of this application.
Figure 2:
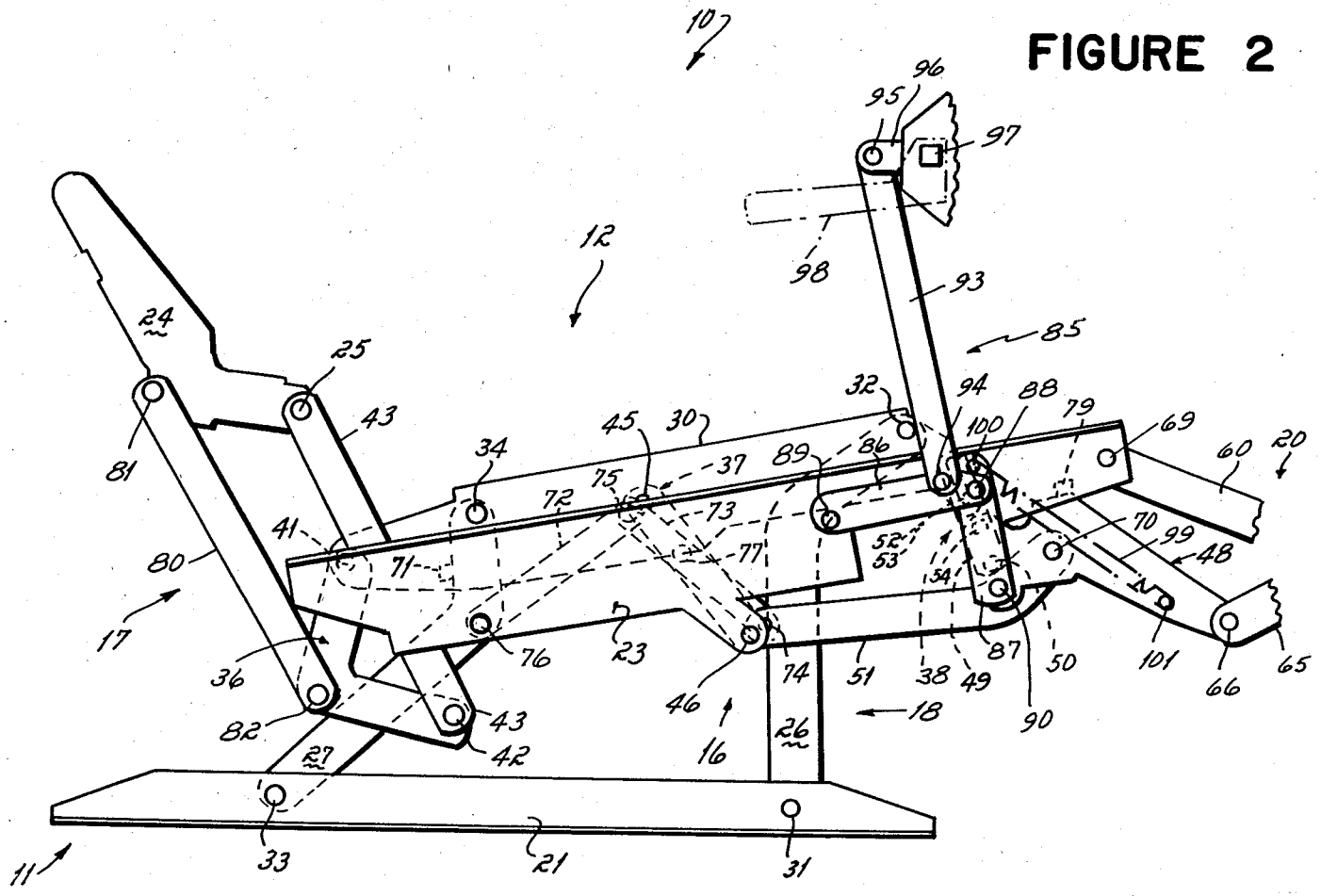
FIG. 2 is a view similar to FIG. 1 but illustrating the linkage mechanism of the chair of FIG. 1 in the position.
Figure 3:
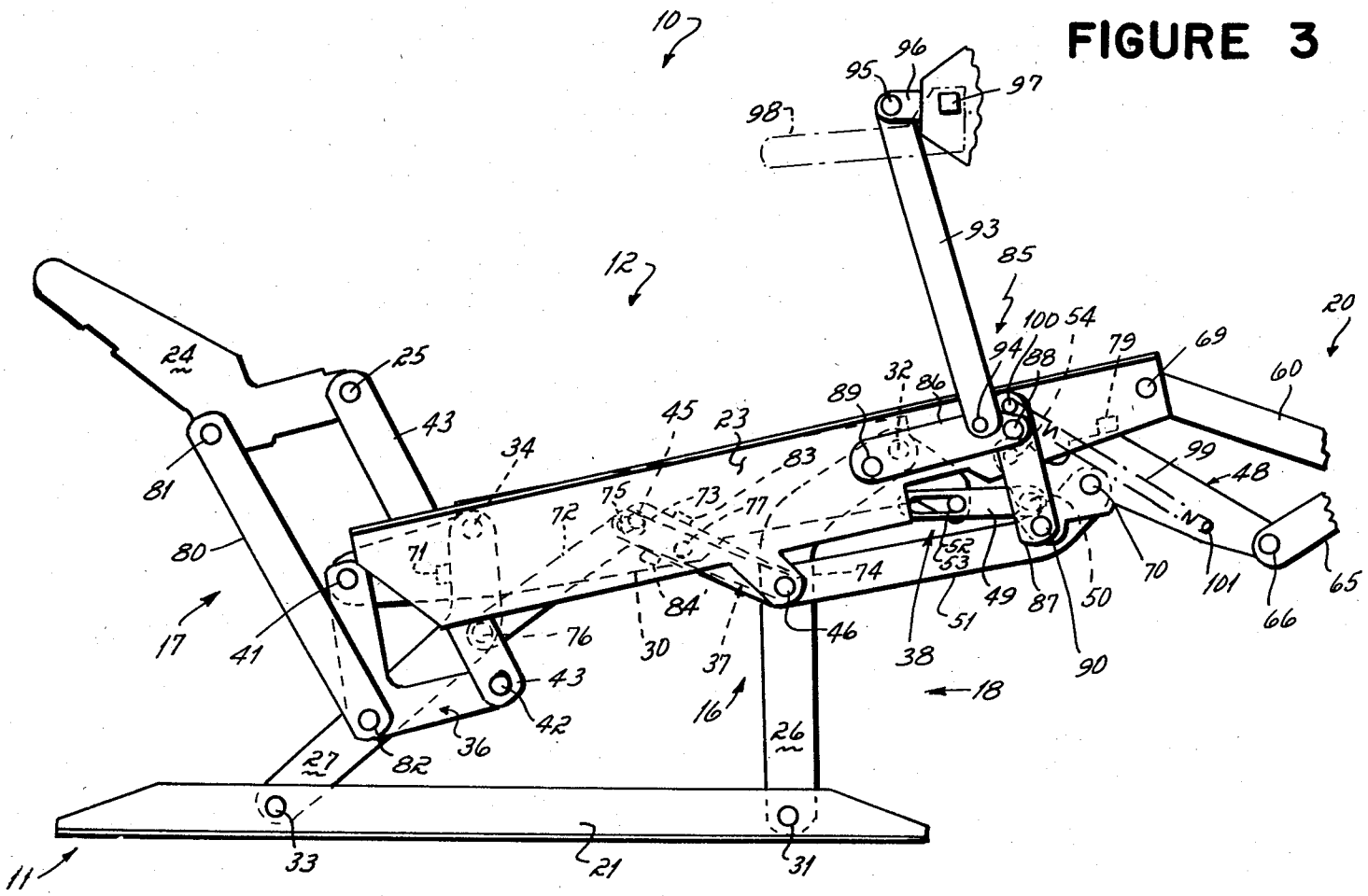
FIG. 3 is a view similar to FIGS. 1 and 2 but illustrating the same linkage mechanism in the full recline position.
Figure 4:
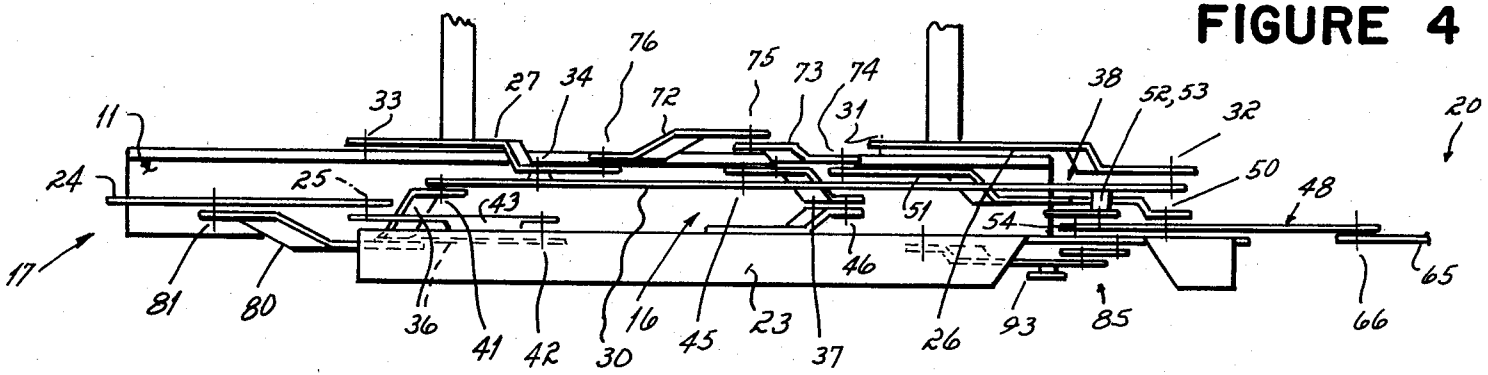
FIG. 4 is a top plan view of the mechanism of FIG. 2.
Figure 8:
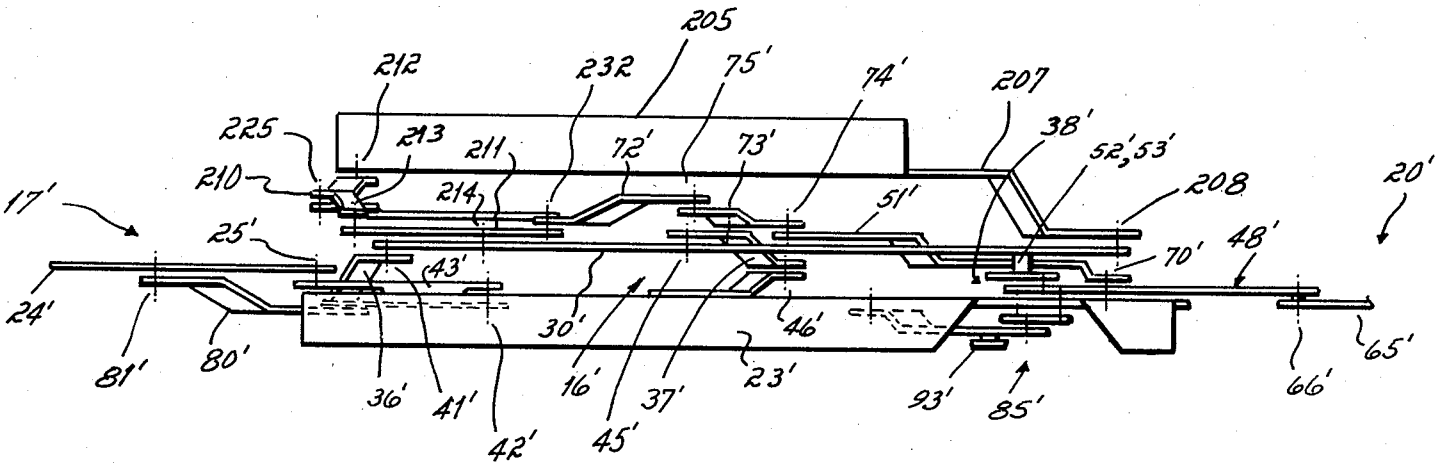
FIG. 8 is a top plan view of the mechanism of FIG. 6.

Referring first to the three-position away-from-the-wall style of reclining chair illustrated in FIGS. 1 through 4, the recliner chair 10 there illustrated includes a stationary base 11 and a body support 12 mounted for movement on this stationary base between upright, TV and full reclined positions as illustrated in FIGS. 1, 2 and 3 respectively. The body support 12 includes a seat frame 13 and backrest frame 14 pivotally connected one to the other. The reclining chair 10 also includes an armrest frame 15 on each side of the chair fixedly attached to the seat frame 13. The chair's seat and armrest frames 13, 15 and backrest 14 are mounted on the base 11 and are interconnected one with another through recliner linkage 16, backrest linkage 17, and a supporting four bar linkage 18. The chair also includes a legrest frame 19 and legrest linkage assembly 20, the legrest linkage assembly 20 being mounted upon the chair's seat frame 13 so as to be movable therewith.

The recliner linkage 16, backrest linkage 17, legrest assembly 20, and four bar linkage 18 illustrated in FIGS. 1 to 3 are found on each side of the chair 10 even though the structure for only one side, the right side, when considered while sitting in the chair, is shown. In other words, the recliner linkage 16, backrest linkage 17, legrest linkage assembly 20 and four bar linkage 18 is duplicated on opposite sides of the chair, only one side being shown in the drawings for purposes of illustration. Further, and although the figures only show the framework 13, 14, 15 and 19 for the chair's seat, backrest, arms and legrest, it will be understood that such framework is suitably adapted for receiving appropriate spring elements, cushioning, upholstery, and the like for completion of a saleable product. In other words, the springs, cushioning and covering of the chair 10 have been eliminated for clarity of illustration in the drawings of this invention. Each of the three positions of the three-position all linkage reclining chair 10 is illustrated in one of the FIGS. 1 through 3. FIG. 1 illustrates the position of the recliner linkage 16, backrest linkage 17, four bar linkage 18 and the legrest linkage assembly 20 when the chair is upright; FIG. 2 illustrates the position of these elements when the chair is in the intermediate or TV position; and FIG. 3 illustrates the position of these elements when the chair is in the full reclined position. As viewed in FIGS. 1 through 3, the armrest frame 15 is located outboard of the linkage assembly 16 supported from a seat mounting plate 23, 23.

The reclining chair 10 as previously mentioned, includes a base frame 11 which is comprised of a base plate 21 on each side thereof (only one of which is shown). The base plates are connected one with the other by cross frame members (not shown), thereby providing a generally square or rectangular base frame 11 for the chair 10 that is stationary relative to ground. Each side of the chair also includes a seat frame mounting plate 23 on which the chair's seat frame 13 is fixed and a back frame mounting plate 24 on which the chair's backrest frame 14 is fixed, the backrest 24 and seat frame 23 mounting plates being pivotally connected one to the other at pivot 25 as explained more fully hereinafter. Each side of the chair also includes a leg frame mounting plate 28 to which the legrest frame 19 is fixed. The seat mounting plate 23, backrest mounting plate 24 and leg frame mounting plate 28 are all interconnected one with the other by the recliner linkage 16, backrest linkage 17, and legrest linkage 20, all of which are comprised solely of mechanical links.

The seat frame mounting plate 23 is suspended from the four bar linkage 18 which is in turn mounted upon the base support plate 21. The four bar linkage includes the base plate 21, a front leg 26, a rear leg 27, and a carrier plate 30. The front leg is pivotally connected at its lower end to the base plate 21 by a pivot 31 and at its upper end to the front of the carrier plate by a pivot 32. The rear leg 27 is pivotally connected to the base plate 21 by a pivot 33 and at the top to the carrier plate by a pivot 34. The pivotal connections of the legs 26, 27 to the base plate 21 and carrier plate 30 permits the carrier plate to move in a forward and rearward direction relative to the base plate 21 as may be seen in a comparison between the view of FIGS. 1, 2 and 3.

The seat supporting plate 23 is suspended from the carrier plate 30 of the four bar linkage by a pair of hanger links 36, 37 and a sequencing linkage 38. One of the hanger links 36 is located at the rear of the chair while the other 37, is located medially of the length of the seat support plate 23. The rear hanger link 36 is pivotally connected at its upper end to the carrier plate 30 by a pivot 41. At its lower end, it is pivotally connected by a pivot 42 to the lower end of a bracket 43 fixedly attached to the seat support plate 23. Since the bracket 43 is riveted or welded to the seat support bracket 23, it is in effect an extension of the seat support plate 23. Consequently, the rear hanger link 36 effectively pivotally interconnects the carrier plate 30 at the pivot 41 to the seat support plate 23 at the pivot 42. The other hanger link 37 is pivotally connected at its upper end to the carrier plate 30 by a pivot 45 and is pivotally connected at its lower end to the seat support plate 23 by a pivot 46.

At its forward end, the seat supporting plate 23 is connected to the carrier plate 30 by the sequencing linkage 38. This linkage 38 comprises two links, a legrest pivot link 48, and a sequence glide link 49. The legrest pivot link 48 and the sequence guide link 49 are pivotally interconnected one to the other by a pivot 50. The upper end of the sequence link is slotted as indicated at 52 and is connected to the front of the carrier plate 30 by a pivot 53 which extends through the slot 52 of the sequence link 49. The upper end of the legrest pivot link 48 is pivotally connected by a pivot 54 to the seat supporting plate 23.

The legrest linkage assembly 20 is in the form of a double-V, lazy tong linkage of the conventional overlapped style. The legrest linkage assembly 20 includes links 55, 56 that form a front V-pair pivotally interconnected by a pivot 57, and links 59, 60 that form a rear V-pair pivotally interconnected by a pivot 61. The front links 55, 59 of each V-pair are pivotally connected by pivots 62, 63 respectively at their free ends to the legrest frame mounting plate 28 and hence, to legrest frame 19. The rear link 56 of the front V-link pair 55, 56 is connected by a pivot 64 to the forward end of a third V-link pair 65, 48 of the footrest linkage. This third V-pair 65, 48 are pivotally interconnected at their ends by a pivot 66. The first V-pair 55, 56 are connected to the second V-pair 57, 60 by a pivot 67 which extends through the links 56, 59 medially of the length of the links and the second pair is connected to the third V-pair by a pivot 68 which extends through the links 60, 65 at a point medially of the ends of these two links. The upper ends of the links 60, 48 are pivotally connected to the seat support plate 23 by pivots 69, 54 respectively.

Actuation of the footrest from retracted to extended position occurs as a consequence of forward movement of the rear leg 27 from the position illustrated in FIG. 1 to the position illustrated in FIG. 2. To this end the rear leg 27 is connected to the legrest pivot link 48 via a rear leg drive link 72, a legrest drive pivot link 73 and a legrest actuating link 51. The legrest actuating link 51 is connected by pivot 70 to the legrest pivot link 48. The opposite end of the legrest actuating link 51 is connected by a pivot 74 to the lower end of the legrest drive pivot link 73. The upper end of the legrest drive pivot link 73 is connected by a pivot 75 to the forward end of the rear leg drive link 72, the rear end of which is pivotally connected by a pivot 76 to the upper end of the rear leg 27. The legrest drive pivot link 73 is pivotally connected by a pivot 77 intermediate of its ends to the hanger link 37.

With reference to FIGS. 1 and 2, it will be seen as the chair moves from the upright to the TV position, the top of the rear leg 27 swings forwardly and downwardly. This motion has the effect of pulling the upper end of the rear leg drive link 72 rearwardly, thereby causing the footrest drive pivot link 73 to rotate in a counterclockwise direction about the pivot 77. This results in the lower end of the legrest drive pivot link 73 moving forwardly, thereby propelling the legrest pivot link 48 forwardly. As the legrest pivot link is driven forwardly it causes the scissor linkage of the legrest linkage assembly 20 to open, thereby propelling the legrest frame mounting plate 28 forwardly to the fully opened position depicted in FIG. 2. This forward movement of the legrest linkage assembly 20 is terminated when the top surface of the legrest pivot link 48 contacts a stop 79 (FIG. 2) of the seat support plate 23.

As mentioned hereinabove, the back frame mounting plate or backrest mounting plate 24 is pivotally connected to the seat support plate 23 by a pivot 25 in the seat support plate bracket 43. Since the bracket 43 is fixedly secured to and forms a part of the seat support plate 23, the pivot 25 acts as a pivot between the backrest support plate 24 and seat support plate 23. The backrest mounting plate 24 is also connected to the lower end of the seat support plate bracket 43 through a full recline drive link 80 and the rear hanger link 36. The full recline drive link 80 is pivotally connected at its upper end by a pivot 81 to the backrest mounting plate 24 and at its lower end by a pivot 82 to the bell-crank shaped rear hanger link 36.

Rearward pivotal movement of the backrest mounting plate 24 about the pivot 25 is effected by a person seated in the chair leaning back against the backrest frame 14. Assuming the chair is in the upright position of FIG. 1, a rearward force upon the frame 14 is transmitted to the backrest mounting plate 24 thereby causing the plate 24 to rotate in a counterclockwise direction as viewed in FIGS. 1–3 about the pivot 25. This results in the full recline drive link 80 moving downwardly thereby driving the lower end of the hanger link 36 forwardly and upwardly as the hanger link pivots about its upper pivot 41. Since the lower end of the hanger link 36 is pivotally attached to the bracket 43 and through the bracket 43 to the seat supporting plate 23, this movement of the hanger link 36 propels the seat supporting plate forwardly and upwardly about the hanger links 36, 37 by which it is suspended from the carrier plate 30. This forward and upward movement of the seat support plate 23 relative to the carrier plate 30 is shown by a comparison of FIGS. 2 and 3. This forward and upward movement of the seat support plate 23 continues until a front surface of the hanger link 37 abuts a stop 83 on the carrier plate 30.

To return the chair from the full recline position (FIG. 3) to the TV position (FIG. 2) the occupant of the chair need only move his shoulders forwardly so as to release the force against the backrest frame 14. The weight of the occupant in the chair then causes the seat mounting plate 23 to move downwardly and rearwardly about the hanger links 36 and 37 until the rear surface of the hanger link 37 engages a stop 84 on the carrier plate 30. Simultaneously, the pivot 53 movable in the slot 52 of the sequence link engages the end of the slot 52 further acting as a stop to prevent any further downward and rearward movement of the seat support plate 23 relative to the carrier plate 30.

It is important to note that as the chair goes from the TV position (FIG. 2) to the full recline position (FIG. 3) there is no movement of the four bar linkage 16 including the carrier plate 30. All that moves is the seat support plate 23 relative to the carrier plate 30 and the backrest mounting plate 24 relative to the seat support plate 23. The advantage of this arrangement is that it enables the chair to be very well balanced so that only a very minimal force upon the backrest frame 14 is required to move the chair from the TV to the upright position.

Because the four bar mechanism 16 of this chair 10 is weight biased forward when the chair is in the upright position, a weight of downward force on the seat acts through the recliner linkage 16 to apply a downward force upon the carrier plate 30 and, in the absence of a latch or lock, to move the carrier plate 30 downwardly and forwardly. A latch must therefore be provided to retain the chair in the upright position when a person is seated in it. Absent such a latch the chair would automatically move from the upright position (FIG. 1) to the TV position (FIG. 2) when a person sat down in the chair. To that end this chair includes a handle operated latch mechanism 85 operable between the legrest linkage assembly 20 and the seat support plate 23 to hold the chair in an upright position with the legrest linkage assembly closed with the footrest frame 19 located adjacent the seat frame 13. This latch mechanism 85 comprises a pair of legrest locking links 86, 87 and a handle actuated lock release link 93. The legrest locking links 86, 87 are movable to an on or over-center position to lock the legrest relative to the seat supporting plate 23. When the legrest is locked in a closed position, the four bar linkage 18 is similarly locked against movement from the upright to the TV position. The locking of the four bar linkage occurs as a consequence of the rear leg 27 of the four bar linkage being secured to the legrest linkage 20 through a legrest actuating link 51, the legrest drive pivot link 73, and the rear drive link 72. Thus, so long as the footrest remains locked against movement relative to the seat support plate 23, the chair cannot move from the upright to the TV position.

The footrest locking links 86, 87 are pivotally interconnected by a pivot 88. The locking link 86 is pivotally connected to the seat support plate 23 at the end remote from the pivot 88 by a pivot 89. The end of the locking link 87 remote from the pivot 88 is connected to the footrest pivot link 48 by a pivot 90.

When the legrest linkage assembly 20 is in a closed position illustrated in FIG. 1, the pivot 90 between the locking link 87 and the legrest pivot link 48 is located beneath the legrest locking link 86 and either in line with a center line 91 drawn through the pivots 88, 89 or slightly above that center line. In order for the footrest linkage to move outwardly, the pivot 90 must move downwardly relative to the center line 91. Absent some external force though to effect that movement, the legrest linkage assembly 20 will remain locked in a closed position relative to the seat support plate 23. To effect relative movement between the links 86, 87 so as to locate the pivot 90 beneath the locking plane 91 (so as to permit the legrest linkage assembly to open) a handle operated lock release link 93 is pivotally attached at one end by a pivot 94 to the locking link 86. The opposite end of the link lock release 93 is pivotally connected by a pivot 95 to a handle link 96. This handle link 96 is fixedly attached to a handle shaft 97 which is in turn secured to a handle 98. When the handle is rotated in a clockwise direction as illustrated in FIGS. 1–3, it has the effect of moving the lock release upwardly, thereby pulling the locking link 86 upwardly to locate the pivot 90 below the centerline 91 extending between the pivots 88, 89. As soon as the locking link 86 has moved a sufficient distance, usually a small fraction of an inch, so as to locate the pivot 90 beneath the centerline 91, the footrest linkage is free to move outwardly to an extended position.

In order to assist in holding the locking links 86, 87 in a locked position, a spring 99 extends between a stop 100 on the locking link 87 and a pin 101 extending from the legrest pivot link 48. As may be seen in FIG. 1, this spring 99 tends to bias the end of the link 87 remote from the pivot 90 downwardly when the linkage is in a closed position, thereby holding the pivot 88 between the two links 86, 87 downwardly against accidental or inadvertent movement. Thus, the spring assists in holding the legrest linkage assembly 20 in a latched closed position. And, so long as the legrest assembly is locked in a closed position, the four bar linkage 18 is restrained against any movement.

OPERATION OF THE AWAY-FROM-THE-WALL RECLINER

The operation of the away-from-the-wall recliner chair 10 is as follows: Assuming that the chair is in the upright position illustrated in FIG. 1, movement of the chair from the upright to the TV position is initiated by movement of the handle 98 in a clockwise direction. This has the effect of pulling the lock release link upwardly thereby displacing the lock links 86, 87 so as to release those links from their locked attitude. Thereby, the legrest linkage assembly 20 is released for movement relative to the seat support plate 23. If a person is seated in the chair when the handle is actuated and the back released, the weight of the person on the seat frame 13 drives the seat support plate 23 downwardly. Since the seat support plate 23 is attached to the carrier plate 30 through the hanger links 36, 37, the weight of the person seated in the chair applies through the hanger links 36, 37 a downward force upon the carrier support plate 30. When the carrier link is pushed downwardly by this force, it is caused to move forward and down about the front and rear legs 26, 27 of the four bar linkage 18. In the course of this movement, the rear of the carrier support plate 30 and the rear of the seat move downwardly to a greater extent than the front of the carrier support plate link and seat because of the dog leg configuration of the legs 26, 27. As the carrier support plate 30 goes forwardly and downwardly, the rear leg 27 of the four bar linkage 18 pulls the rear of the rear leg drive link 72 downwardly, thereby causing the legrest drive pivot link 73 to rotate in a counterclockwise direction as viewed in FIGS. 1–3 about its pivot 77, thereby pushing the bottom of the legrest drive pivot link 73 forwardly. This results in the legrest actuating link 51 being pushed forwardly and pushing the legrest pivot link 48 forwardly. The legrest linkage assembly 20 then continues to open as a result of the force applied to the four bar linkage 18 by the weight of a person seated in the chair until the top surface of the legrest pivot link 48 contacts the stop 79 on the front end of the seat support plate 23. The chair is then in the TV position. In this TV position a safety stop 71 near the rear of the carrier support plate 30 also engages the rear surface of the rear leg 27 of the four bar linkage 18 to prevent any further forward movement of the carrier support plate 23.

To go from TV to full recline position, a person seated in the chair simply leans back on the backrest frame 14. This has the effect of rotating the backrest mounting plate 24 about a front pivot 25 attached to the rear support plate 23. As the backrest mounting plate 24 rotates, it drives the lower end of the rear hanger link 36 upwardly and forwardly thereby causing the seat support plate 23 to move upwardly and forwardly about the hanger links 36, 37. The seat then continues to move forwardly and upwardly until the front hanger link contacts a stop 83 on the carrier link. At this time the mechanism is in the full recline position.

To then return the chair 10 from full recline to TV position, a person seated in the chair simply moves his shoulders forward so as to take his weight off of the backrest frame 14 and the backrest frame mounting plate 24. The weight of the person seated in the chair then causes the seat frame 13 and seat frame supporting plate 23 to swing downwardly on the hanger links 36, 37 about the carrier plate 30 while the carrier plate remains in a fixed position relative to the base support plate 21. The seat support plate 23 stops its movement relative to the carrier plate 30 in the TV position of the chair when the front hanger link 37 contacts the stop 84 on the carrier plate 30.

To move the chair 10 from the TV to the upright position, a person pushes down on the legrest frame 19 with the rear of his legs, thereby causing the legrest linkage assembly 30 to close. In the course of the legrest linkage assembly 20 closing, the rear leg 27 of the four bar linkage 18 is caused to pivot rearwardly about the pivot 33. This rearward movement of the rear leg 27 is effected by the rearward movement of the legrest pivot link 48 driving the upper end of the rear leg 27 rearwardly about the pivot 33 through the links 51, 73 and 72. Since the upper end of the rear leg is connected to the carrier plate 30 by the pivot 34, the carrier plate is also moved rearwardly. And, as the carrier plate moves rearwardly the support plate which is connected to the carrier plate by the reclining linkage 16 moves rearwardly with it until the seat plate 23 reaches the upright position. In the upright position of the chair a stop 103 on the legrest linkage assembly contacts a link 56 of the linkage assembly 20 simultaneously with the chair lock links 86, 87 driving into an on-center or over-center locked position.

ROCKER RECLINER EMBODIMENT

With reference to FIGS. 5–8, there is illustrated a rocker recliner embodiment of this invention. This rocker recliner embodiment 200 has in common with the away-from-the-wall embodiment 10 of FIGS. 1–4 a common body support 12' including the seat frame 13', backrest frame 14' and armrest frame 15'. Additionally, this embodiment 200 has a common recliner linkage 16; backrest linkage 17' and legrest linkage assembly 20'. Additionally, the latch mechanism 85' for securing the seat support plate 23' and legrest linkage assembly 20' against movement relative to the carrier plate is identical to that disclosed in the embodiment of FIGS. 1–4. Accordingly, those components of the two embodiments 10, 200 which are identical have been given the same numerical designation in the rocker recliner embodiment of FIGS. 5–8 as has been employed in the away-from-the-wall recliner embodiment of FIGS. 1–4 but followed by a prime mark to distinguish the two.

Because the seat frame mounting plates 23, 23′, the backrest frame mounting plates 24, 24′ and the legrest mounting plates 28, 28′ as well as the interconnecting linkages 16, 16′ and 20, 20′ are identical, identical chair frames may be mounted upon the supporting plates to create identical appearing chairs but with different action motions. As described hereinabove, this is important from a commercial merchandising standpoint.

The primary difference between the rocker recliner chair embodiment 200 of FIGS. 5–8 and the away-from-the-wall chair embodiment 10 of FIGS. 1–4 resides in the interconnection of the carrier plate 30, 30′ to the supporting base. In the away-from-the-wall chair 10 of FIGS. 1–4, the base is a stationary rectangular base including a base support plate 21 connected to the carrier plate 30 via a four bar linkage 18 while in the rocker recliner of FIGS. 5–8 the carrier plate 30′ is supported upon a movable base which includes a rocker cam 202. With reference now to FIGS. 5–8, it will be seen that the rocker cam 202 is resiliently supported by a conventional spring mount (not shown) upon a stationary base 203 over which the rocker cam 202 is oscillatable. A rocker cam mounting plate or rocker support plate 205 is mounted atop the rocker cam 202. This plate is fixedly secured to the rocker cam 202 by conventional screws or connectors. Extending upwardly from the forward end of the rocker support plate 205 there is an arm 207, the upper end of which is pivotally attached to the forward end of the carrier plate 30′ by a pivot 208.

Figure 5:
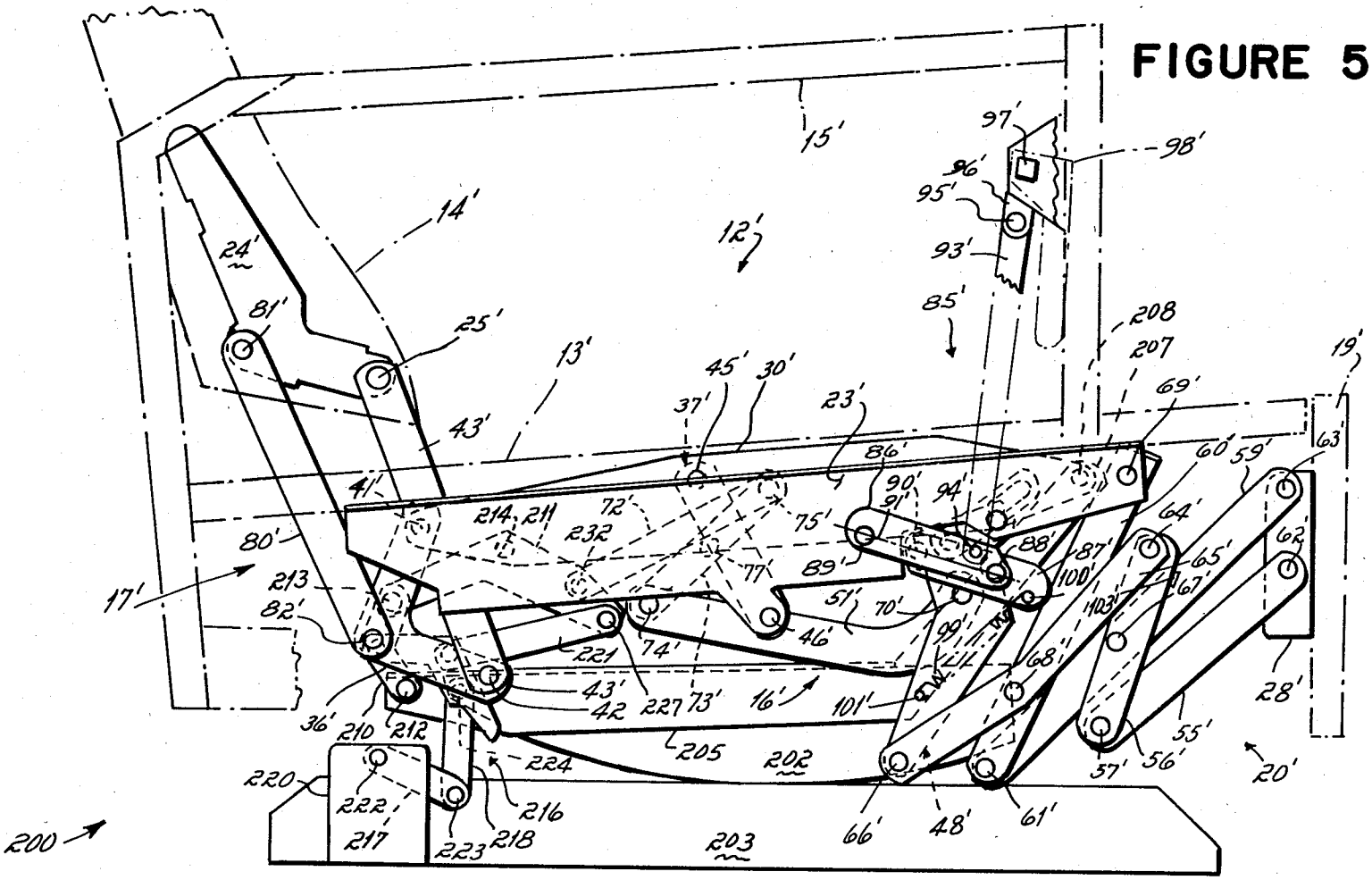
FIG. 5 is a side elevational view of a three-position rocker recliner chair incorporating the invention of this application.
Figure 6:
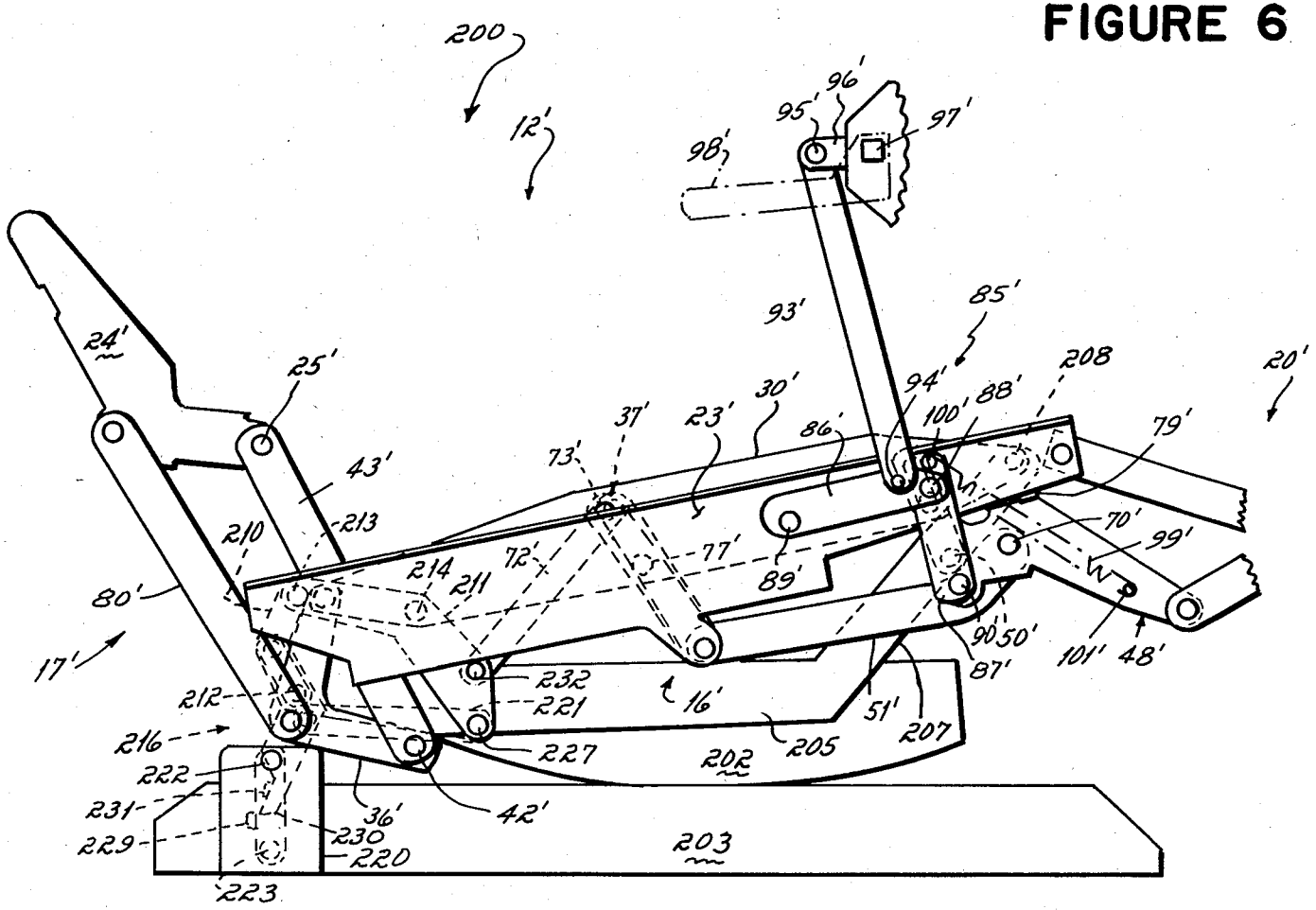
FIG. 6 is a view similar to FIG. 5 but illustrating the rocker recliner mechanism in an intermediate TV position.
Figure 7:
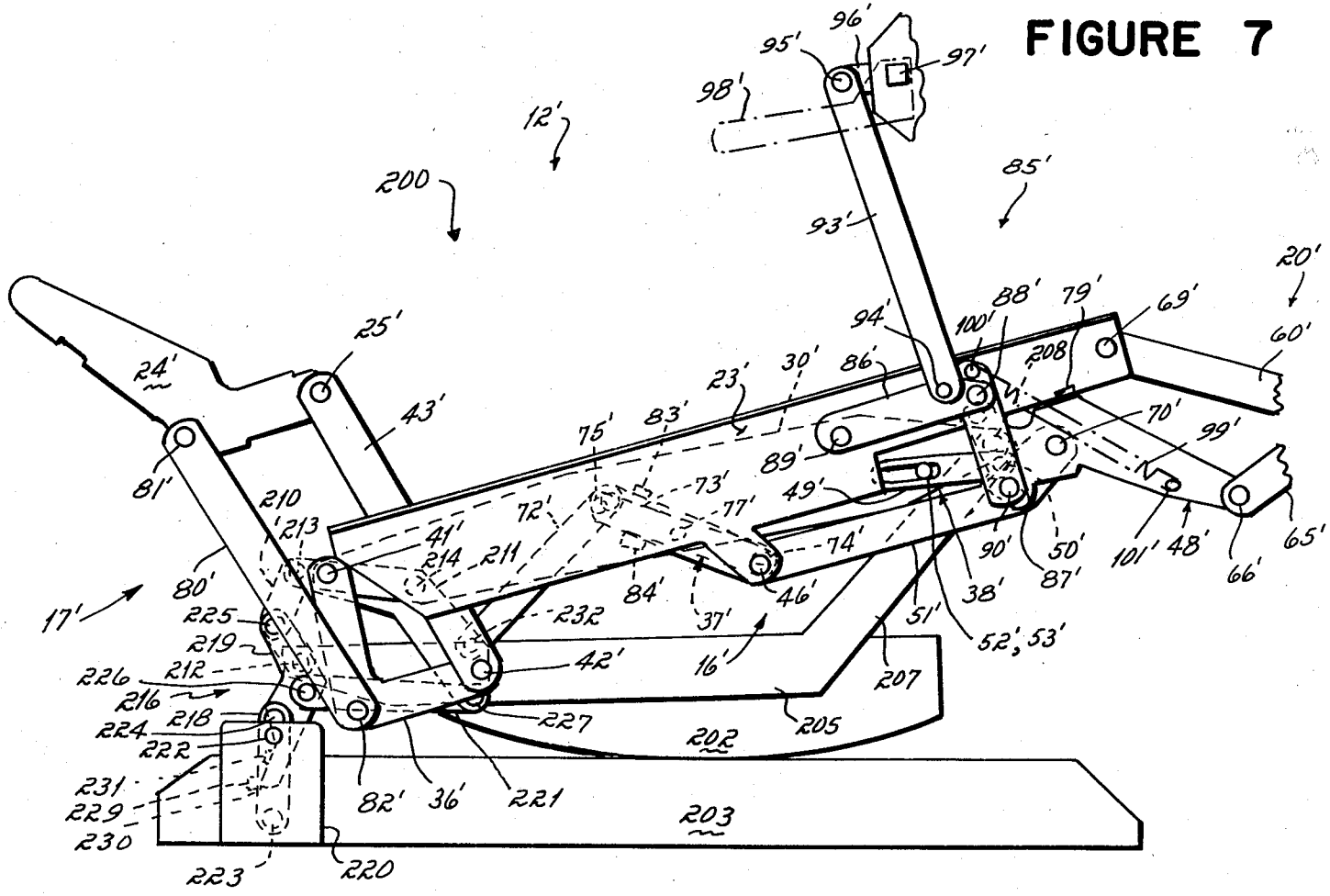
FIG. 7 is a view similar to FIGS. 5 and 6 but illustrating the recliner mechanism in the full recline position.
Figure 9:
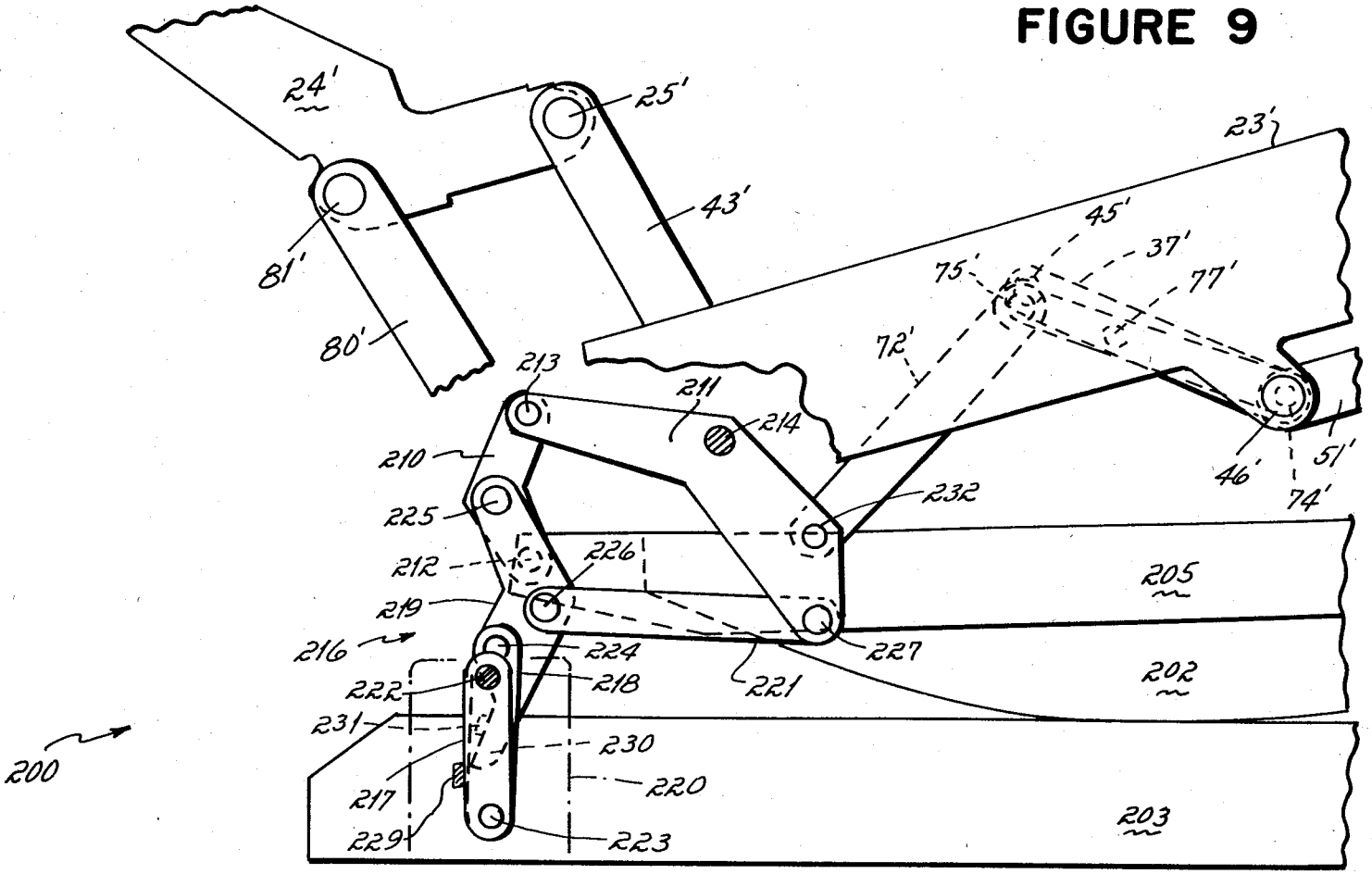
FIG. 9 is an enlarged fragmentary view of the rocker lock linkage of FIGS. 5–8.

With reference to a comparison of FIGS. 5 and 6 it will be seen as the chair goes from upright to TV position the carrier plate 30′ as well as the complete recliner linkage 16′ pivots about the fixed pivot 208, simply dropping the rear of the rocker recliner linkage including the rear of the seat frame mounting plate 23′ downwardly relative to this pivot 208.

The rear of the carrier plate 30′ is supported from the rear of the rocker cam mounting plate 205 by a pair of bellcrank shaped links 210, 211. The link 210 is pivotally connected at its lower end to the rocker cam mounting plate 205 by a pivot 212 while the upper end of this link 210 is pivotally connected to the link 211 by a pivot 213. Intermediate its ends the link 211 is pivotally secured to the carrier link 30′ by a pivot 214. The two links 210, 211 thus support the rear of the carrier link 30′ upon the rocker cam mounting plate 205 for pivotal movement about the front pivot 208 when the chair goes from upright to TV position or vice versa.

When the rocker recliner 200 is moved from the upright to the TV position, as illustrated in FIGS. 5 and 6 respectively, it is important that the rocker cam 202 be locked against movement relative to the stationary base 203. If this were not the case, the weight of a person's legs on the extended legrest in the TV or full recline position could cause the rocker to tip over forwardly, or at least tip forward far enough for the extended footrest to contact the floor in front of the chair. Alternatively, if the chair was not locked against rocking movement in the TV or full recline position, the chair might rock back so far as to cause the chair to tip over in a rearward direction because of the center of gravity of the person seated in the chair having been moved rearwardly when the chair was moved from the upright to the TV or full recline position. To that end the rocker recliner 200 of this invention incorporates a rocker lock linkage 216 at the rear of the chair operable to lock the chair against rocking movement when the chair is moved from the upright to the TV position. The lock linkage 216 then remains locked when the chair moves from a TV to the full recline position and is only unlocked if the chair returns to the upright position illustrated in FIG. 5.

The rocker lock linkage 216 comprises three interconnected locking links 217, 218 and 219. These three interconnected links 217, 218, 219 extend between a bracket 220 secured to the fixed base 203 and the carrier plate supporting link 210. Since the link 210 is attached by pivot 212 to the rocker cam mounting plate 205, the rocker lock linkage 216 effectively extends between the rocker cam mounting plate 205 and the fixed base mounting bracket 220. The rocker lock linkage 216 is actuated and controlled by a lock actuating link 221 which extends between the carrier plate supporting link 211 and the locking link 219.

The link 217 of the rocker lock linkage 216 is pivotally connected at its upper end to the top of the generally U-shaped fixed base bracket 220 by a pivot 222. The lower end of this link 217 is pivotally connected to the lower end of the link 218 by a pivot 223. At its upper end, the link 218 is pivotally connected to the lower end of the link 219 by a pivot 224. The upper end of the link 219 is connected to the center of the bellcrank shaped link 210 by a pivot 225. Intermediate its ends, the uppermost of the three links, the link 219, is pivotally connected to one end of the lock actuating link 221 by a pivot 226. The forward end of the lock actuating link 221 is pivotally connected to the lower end of the carrier plate supporting link 211 by a pivot 227.

With reference first to FIG. 5, it will be seen that when the chair is in an upright position, the three links 217, 218 and 219 are out of alignment so that the rocker cam mounting plate 205 is free to move relative to the fixed cam mounting bracket 220 without any interference by the rocker lock linkage 216. When the chair though moves from the upright to the TV position, as explained more fully hereinafter, both the back of the seat support plate 23′ and the carrier link 30′ drop downwardly relative to the front pivot 208 between the rocker cam mounting plate 205 and the carrier plate 30′. As the rear of the carrier plate 30′ drops downwardly, the pivot 214 between the carrier plate 30′ and the bellcrank shaped seat supporting link 211 is moved downwardly (compare FIG. 5 to FIG. 6). Downward movement of the pivot 214 of the bellcrank 221 causes the lower end of the bellcrank shaped link 211 and its lower pivot 227 to be moved downwardly and rearwardly as the link 211 rotates about its upper pivot 213. This downward and rearward movement of the pivot 227 forces the lock actuating link 221 to move rearwardly, thereby moving the three links 217, 218 and 219 into a generally vertical alignment until the rear edge of the link abuts a stop 229 of the mounting plate 220 and a depending finger 230 of the link 219 engages a fixed stop 231 on the link 218. When both of these stops 229, 231 are engaged by their respective stop surfaces, the links 217, 218 and 219 are generally vertically aligned with the pivots 223, 224, and 225 of these links generally aligned in an on-center or over-center toggle locking arrangement. When the pivots are so aligned, the rocker cam mounting plate 205 is locked against rocking movement relative to the fixed rocker base bracket 220.

OPERATION OF ROCKER RECLINER

In use, the rocker recliner 200 is free for rocking movement so long as it is in the upright position (FIG. 5). Movement to the TV position (FIG. 6) locks the rocker cam 202 against movement relative to the fixed base 203 as has been explained heretofore relative to the rocker lock linkage 216.

When a person sits in the chair 200, a downward force is applied to the seat support plate 23' and thus through the hanger links 36', 37' of the recliner linkage 16' to the carrier plate 30'. This downward force on these two plates 23', 30' has no operative effect relative to the recliner linkage 16' unless or until the legrest latch mechanism 85' is released or moved to an unlocked condition. Release of the latch mechanism 85' is effected by the handle 98'. Rotation of the handle 98' in the counterclockwise direction as viewed in FIGS. 5–8, has the effect of moving the lock release link 93' upwardly, thereby moving the legrest lock link 86' upwardly so as to locate the pivot 90' of the latch mechanism 85' below the center line through the pivots 88', 89'. This has the effect of releasing the legrest linkage assembly for outward movement relative to the seat support plate 23' and through the footrest actuating linkage 51, 73, 72, releasing the rear of the carrier plate 30' for downward pivoting movement about the front pivot 208. The weight of the occupant of the chair then causes the rear of the seat support plate 23' and the rear of the carrier plate 30' to pivot downwardly about front pivot 208 until movement of the legrest linkage assembly 20' is terminated by contact of the top surface of the legrest link 48' with the stop 79' on the seat support plate 23'.

As the rear of the seat is lowered about the front pivot 208, the pivotal connection 214 between the seat support plate 23' and the seat support link 211 moves downwardly, thereby causing the rear seat support link 211 to pivot about its pivotal connection 213 to the link 210. This pivotal movement of the link 211 results in the lower end of the link 211 actuating the rocker lock linkage 216 through the pivot 227 and lock actuating link 221, and simultaneously, through the pivot 232, actuating the legrest drive linkage 72', 73', 51' to effect opening of the legrest linkage assembly. Thereby, the rocker cam 202 is locked against rocking movement relative to the stationary base 203 and the legrest is driven to an open position until the top surface of the legrest pivot link 48' engages the stop 79' on the seat support plate 23'.

In this intermediate or TV position of the rocker recliner 200, the rear of the seat is lowered or "bucketed" relative to the front of the seat and the legrest is extended.

The chair in the TV position is now free to move to a full recline position by application of a rearward force to the backrest frame. This force is applied by a person sitting in the chair leaning back against the backrest, thereby causing the backrest mounting plate 24' to pivot about the pivot 25' between the backrest mounting plate and the seat supporting plate bracket 23'. As the backrest mounting plate 24' pivots, it drives the full recline drive link 80' downwardly, thereby pivoting the lower end of the rear hanger link 36' upwardly and forwardly. This has the effect of driving the seat support plate 23' upwardly and forwardly relative to the then stationary carrier plate 30'. The seat support plate 23' moves forwardly about the hanger links 36', 37' upon which it is suspended from the carrier plate 30' until the top surface of the front hanger link 37' abuts the stop 83'. The chair will remain in this full recline position so long as the force is maintained against the backrest frame 14' and thus against the backrest mounting plate 24'. When that force is released by a person leaning forwardly in the seat, the backrest mounting plate 24' returns to the upright position, and in so doing allows the seat supporting plate 23' to move downwardly and rearwardly relative to the stationary carrier plate 30' about the hanger links 36', 37' until the rear edge of the hanger link 37' abuts the stop 84' on the carrier plate 30'.

The chair 200 will remain in the TV position until a force is applied by the occupant of the chair against the legrest frame 19 to force the legrest linkage assembly to a closed position. This has the effect, through the legrest actuating linkage 51', 73', 72' of pivoting the lower end of the seat supporting link 211 forwardly, thereby through the pivoted connection 214 lifting the rear of the carrier plate 30 and through the hanger links 36', 37' the rear or the seat support plate 23' upwardly until the locking links 86', 87' of the latch mechanism 85' move on or over-center into a latched position. Simultaneously, with the return of the chair from the TV to the upright position, the rocker lock actuating link 221 is moved forwardly with the lower end of the link 211. This results in the rocker lock linkage 216 being moved to the unlocked position illustrated in FIG. 5. The chair upright is thus free for rocking movement of the rocker cam support plate and the attached rocker cam relative to the bracket 220 and the fixed base 203.

While I have described only two embodiments of my invention, persons skilled in the art to which this invention pertains will appreciate numerous modifications and changes which may be made without departing from the spirit of my invention. Therefore, I do not intend to be limited except by the scope of the following appended claims.

I claim:

1. A three position rocker recliner chair mechanism comprising, a fixed base, a rocker cam movably mounted upon the fixed base, a rocker base plate fixedly mounted upon the rocker cam, a carrier plate, the front of said carrier plate being pivotally connected to said rocker base plate, rear linkage means connecting the rear of said carrier plate to said rocker base plate, said rear linkage means permitting the rear of said carrier plate to move downwardly relative to said rocker base plate as the front of said carrier plate pivots about the front of said rocker base plate, a seat support plate, a backrest support plate mounted for pivotal movement relative to said seat support plate, recliner linkage means supporting the seat support plate from said carrier plate, the rear of said seat support plate being movable downwardly with the rear of said carrier plate as the mechanism moves from an upright position to a TV position in response to the weight of a person in the chair, releaseable locking means for preventing movement of said seat support plate from said upright to said TV position, release means for releasing said locking means to allow movement of said seat from said upright to said TV position, a footrest, footrest linkage means mounted to the seat for moving the footrest between a retracted position adjacent the seat and an extended position projected forwardly of the seat in response to movement of the seat from said upright to said TV position, and backrest linkage means cooperable with said recliner linkage means to effect forward and upward movement of said seat support plate relative to said carrier plate while said carrier plate remains in a fixed position relative to said rocker base plate as said rocker recliner chair mechanism moves from the TV to the full recline position in response to pivotal movement of said backrest support plate relative to said seat support plate.

2. The rocker recliner of claim 1 which further includes rocker locking means for locking said rocker cam against movement relative to said fixed base, and means for actuating said rocker locking means in response to movement of said rocker recliner mechanism from the upright to the TV position.

3. A rocker recliner linkage mechanism for use in a rocker recliner chair, which mechanism comprises, a rocker base plate adapted to be attached to a rocker cam, a seat support plate, seat support means connecting the seat support plate to the rocker base plate so as to permit the rear of the seat support plate to drop downwardly relative to the front of the seat support plate as the seat support plate moves from an upright position to a TV position in response to the weight of a person in the chair acting downwardly upon the seat support plate, releaseable locking means for preventing movement of said seat support plate relative to said rocker base plate, release means for releasing said locking means to allow movement of the seat support plate from said upright to said TV position, a footrest linkage means mounted to the seat support plate for moving the footrest between a retracted position adjacent the seat support plate and an extended position projected forwardly of the seat support plate in response to movement of the seat support plate from said upright to said TV position.

4. The rocker recliner mechanism of claim 3 which further includes a backrest support plate pivotally connected to said seat support plate, said mechanism further including backrest linkage means for moving said seat support plate forwardly and upwardly to position said backrest support plate and seat support plate in a full recline position in response to a person seated in the chair pushing back and applying a force against the backrest support plate when the mechanism is in the TV position.

5. The rocker recliner mechanism of claim 3 which further includes rocker locking means for locking said rocker base plate against rocking movement and means for actuating said rocker locking means in response to movement of said rocker recliner mechanism from the upright to the TV position.

6. The rocker recliner mechanism of claim 3 wherein said seat support means comprises a carrier plate pivotally connected at the front end to said rocker base plate and connected at the rear to said rocker base plate so as to permit said rear of said carrier plate to move toward and away from the rear of said rocker base plate as said carrier plate pivots about the front of said rocker base plate.

7. The rocker recliner mechanism of claim 6 wherein said rear of said carrier plate is connected to the rear of said rocker base plate by at least two pivotally interconnected links connecting the rear of said carrier plate to the rear of said rocker base plate.

8. The rocker recliner mechanism of claim 6 wherein said seat support means includes recliner linkage means interconnecting said seat support plate and said carrier plate, a backrest support plate pivotally connected to said seat support plate, and said mechanism further including backrest linkage means for moving said seat support plate forwardly and upwardly to position said backrest support plate and seat support plate in a full recline position in response to a person seated in the chair pushing back and applying a force against the backrest support plate when the mechanism is in the TV position.

9. The rocker recliner mechanism of claim 3 wherein said release means includes a rotatable handle and at least one link interconnecting said handle to said releaseable locking means.

10. The rocker recliner mechanism of claim 3 wherein said releaseable lock means comprises two lock links pivotally interconnected at a first pivot, one of said links being pivotally connected to said footrest linkage by a second pivot and the other link being pivotally connected to said seat support plate by a third pivot, and said second pivot being movable upon movement of said footrest to a retracted position into a locked position in which said second pivot is in line with said first and third pivots.

11. A rocker recliner linkage mechanism for use in a rocker recliner chair, which mechanism comprises, a stationary base plate, a rocker cam resiliently mounted for rocking movement on said base plate, a rocker base plate fixedly attached to said rocker cam, a seat support plate, seat support means connecting the seat support plate to the rocker base plate so as to permit the rear of the seat support plate to drop downwardly relative to the front of the seat support plate as the seat support plate moves from an upright position to a TV position, a footrest linkage means mounted to the seat support plate for moving the footrest between a retracted position adjacent the seat support plate and an extended position projected forwardly of the seat support plate in response to movement of the seat support plate from said upright to said TV position, and all linkage locking means pivotally connected at its opposite ends to said rocker base plate and said fixed base plate for securing said rocker base plate against movement relative to said stationary base plate in response to movement of said seat support plate to a TV position, said locking means comprising three pivotally interconnected links and a lock actuating link, said lock actuating link being operatively connected to said seat support plate so that movement of said support plate relative to said rocker base plate effects movement of said lock actuating link.

12. The rocker recliner linkage of claim 11 wherein said lock actuating link is connected to said seat support plate so that dropping of the rear of the seat support plate relative to the front of the seat support plate effects movement of said lock actuating link and thereby causes said three locking links to be moved into generally linear alignment whereby said rocker base plate is locked against rocking movement relative to said stationary base plate.

13. A rocker recliner linkage mechanism for use in a rocker recliner chair, which mechanism comprises, a stationary base plate, a rocker cam resiliently mounted for rocking movement on said base plate, a rocker base plate fixedly attached to said rocker cam, a seat support plate, seat support means connecting the seat support plate to the rocker base plate so as to permit the rear of the seat support plate to drop downwardly relative to the front of the seat support plate as the seat support plate moves from an upright position to a TV position, a footrest linkage means mounted to the seat support plate for moving the footrest between a retracted position adjacent the seat support plate and an extended position projected forwardly of the seat support plate in response to movement of the seat support plate from said upright to said TV position, and all linkage locking means for securing said rocker base plate against movement relative to said stationary base plate in response to movement of said seat support plate to a TV position, said locking means comprising three pivotally interconnected links and a lock actuating link, the first of said three links being pivotally connected by a first pivot to said rocker base plate, the opposite end of said first link being pivotally connected by a second pivot to the second of said three links, the opposite end of said second link being pivotally connected to one end of said third link, the opposite end of said third link being pivotally connected to said stationary base plate, said lock actuating link being pivotally connected to said first link intermediate the ends of the first link and operable to move said three links into generally linear alignment so as to secure said rocker base plate against movement relative to said stationary base plate.

14. A rocker recliner chair mechanism comprising, a fixed base, a rocker cam movably mounted upon the fixed base, a rocker base plate fixedly mounted upon the rocker cam, a carrier plate, the front of said carrier plate being pivotally connected to said rocker base plate, rear linkage means connecting the rear of said carrier plate to said rocker base plate, said rear linkage means permitting the rear of said carrier plate to move downwardly relative to said rocker base plate as the front of said carrier plate pivots about the front of said rocker base plate, a seat support plate, a backrest mounted to said seat support plate, recliner linkage means supporting the seat support plate from said carrier plate, the rear of said seat support plate being movable downwardly toward the rear of said carrier plate as the mechanism moves from an upright position to a TV position in response to the weight of a person in the chair, releaseable locking means for preventing movement of said seat support plate from said upright to said TV position, release means for releasing said locking means to allow movement of said seat from said upright to said TV position, a footrest, footrest linkage means mounted to the seat for moving the footrest between a retracted position adjacent the seat and an extented position projected forwardly of the seat in response to movement of the seat from said upright to said TV position, and said recliner linkage means being operable to effect forward and upward movement of said seat support plate relative to said carrier plate while said carrier plate remains in a fixed position relative to said rocker base plate as said rocker recliner chair mechanism moves from the TV to the full recline position in response to a rearward force applied to said backrest.

15. The rocker recliner mechanism of claim 14 wherein said backrest is pivotally connected to said seat support plate, said mechanism further including backrest linkage means operatively connected to said recliner linkage means for moving said seat support plate forwardly and upwardly relative to said rocker base plate to move said backrest and seat support from a TV to a full recline position.

16. The rocker recliner of claim 14 which further includes rocker locking means for locking said rocker cam against movement relative to said fixed base, and means for actuating said rocker locking means in response to movement of said rocker recliner mechanism from the upright to the TV position.

17. A recliner mechanism for use in a recliner chair, which mechanism comprises, a base, a seat support, seat support means connecting the seat support to the base so as to permit the rear of the seat support to drop downwardly about a pivot fixed relative to the base adjacent the front of the seat support as the seat support moves from an upright position to a TV position in response to the weight of a person in the chair acting downwardly upon the rear of the seat support, releasable locking means for preventing movement of said seat support relative to said base, release means for releasing said locking means to allow movement of the seat support from said upright to said TV position, a footrest linkage means mounted to the seat support for moving the footrest beteween a retracted position adjacent the seat support and an extended position projected forwardly of the seat support in response to movement of the seat support from said upright to said TV position.

18. The recliner mechanism of claim 17 which further includes a backrest support connected to said seat support, said mechanism further including backrest linkage means for moving said seat forwardly and upwardly to position said backrest support and seat support in a full recline position in response to a person seated in the chair pushing back and applying a force against the backrest support when the mechanism is in the TV position.

19. The recliner mechanism of claim 17 wherein said seat support means comprises a carrier plate pivotally connected at the front end to said base and movably connected at the rear to said base so as to permit said rear of said carrier plate to move toward and away from the rear of said base as said carrier plate pivots about said fixed pivot.

20. The recliner mechanism of claim 19 wherein said rear of said carrier plate is connected to the rear of said base plate by at least one movable link connecting the rear of said carrier plate to the rear of said base.

* * * * *

UNITED STATES PATENT AND TRADEMARK OFFICE

CERTIFICATE OF CORRECTION

PATENT NO. : 4,577,902

DATED : March 25, 1986

INVENTOR(S) : Michael A. Crum

It is certified that error appears in the above-identified patent and that said Letters Patent is hereby corrected as shown below:

Column 6, line 40, after "the" (second occurrence) insert -- intermediate TV --

Column 6, line 53, after "the" insert -- rocker --

Signed and Sealed this

Seventh Day of October, 1986

[SEAL]

*Attest:*

DONALD J. QUIGG

*Attesting Officer*

*Commissioner of Patents and Trademarks*